US006312147B2

(12) United States Patent
Eichler

(10) Patent No.: US 6,312,147 B2
(45) **Date of Patent: *Nov. 6, 2001**

(54) VEHICLE PROTECTION-TYPE HEADLAMP WITH MOVABLE SHADE DEVICES

(75) Inventor: Heike Eichler, Reutlingen (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/217,733

(22) Filed: Dec. 21, 1998

(30) Foreign Application Priority Data

Feb. 20, 1997 (DE) ..... 198 7 153

(51) Int. Cl.[7] ..... F21V 11/00

(52) U.S. Cl. ..... 362/539; 362/507; 362/538; 362/512; 362/513; 362/464; 362/465

(58) Field of Search ..... 362/459, 487, 362/506, 507, 538, 539, 319, 322, 324, 351, 361, 512, 513, 464, 465

(56) References Cited

U.S. PATENT DOCUMENTS 5,161,875 * 11/1992 Sekiguchi et al. ..... 362/539
5,339,226 * 8/1994 Ishikawa ..... 362/539

FOREIGN PATENT DOCUMENTS 40 02 576 A1 8/1991 (DE) .

* cited by examiner

*Primary Examiner*—Sandra O'Shea
*Assistant Examiner*—Ismael Negron
(74) *Attorney, Agent, or Firm*—Michael J. Striker

(57) ABSTRACT

A headlight for a vehicle operating in a projection principle has a light source, a reflector reflecting a light emitted by the light source, a lens arranged in a course of light reflected by the reflector, a first shade device located between the reflector and the lens and changeable between at least one first condition for a first operational position of the headlight and at least one second condition for a second operational position of the headlight, the first shade device in the first condition screening a part of the light reflected by the reflector and producing a bright-dark limit of a light bundle exiting the headlight, and in the second condition screening at least only a smaller part of a light reflected by the reflector than in the first condition, and a further shade device arranged in a direction of an optical axis offset relative to the first shade device and changeable between at least one first condition and at least one second condition, the further shade device in the first condition screening a part of a light reflected by the reflector and passing on the first shade device in the first condition so as to reduce a maximum illumination intensity value produced by a light bundle exiting the headlight in the first operational position, the further shade device in the second condition screening at least only a smaller part of a light reflected by the reflector.

12 Claims, 5 Drawing Sheets

VEHICLE PROTECTION-TYPE HEADLAMP WITH MOVABLE SHADE DEVICES

BACKGROUND OF THE INVENTION

The present invention relates to a headlight for vehicle in accordance with a projection principle.

Headlights of the above mentioned general type are known in the art. One of such headlights is disclosed for example in the German patent document DE 40 02 576 A1. The headlights serves for selectively producing a low beam or a high beam. The headlight has a light source and a reflector for reflecting the light emitted by the light source. A lens is arranged in a beam course of the reflector and a shade device is arranged between the reflector and the lens. The shade device is changeable between a first condition for the operational position of the headlight for the low beam, and a second condition for the operational position for the high beam. The shade device screens in the first condition a part of the light reflected by the reflector and produces a bright-dark limit of the low beam bundle exiting the headlight. In the second condition the shade device shades at least a small part of the light reflected by the reflector. The change of the shade device between its first and second condition can be performed by its movement or the shade device can have at least locally a changeable light permeability, so that the light permeability in the first condition of the shade device is low and in the second condition is high.

The above described known headlight has the disadvantage that it can be optimal either for producing the low beam or for producing the high beam. However, no design is possible for optimal production of both light functions, since the requirements for them are partially contradictory. If the headlight is optimal for the production of the low beam, with the shade device in the first condition, then in the operational position for the high beam with the shade device in the second condition no efficient high beam is produced, since the high beam bundle exiting the headlight can be produced with very low maximum illumination intensities. If to the contrary the headlight is designed so that in its operational condition for high beam with the shade device in its second condition an efficient high beam bundle with its maximum illumination intensities is emitted, then the shade device in its first condition for the operational position of the headlight for low beam must be arranged so that a greater part of light reflected by the reflector is shades, since otherwise the low beam can be produced with impermissibly high illumination intensities. With the arrangement of the shade device required for this in the first condition, moreover substantial image forming error by the lens occurs, such as color edge or over radiation which jointly negatively affects the quality of the low beam bundle. Moreover, the headlight in the operational condition for the low beam is adjusted so that the bright-dark limit assumes the prescribed position, but in the operational position for the high beam the regions with the maximum illumination intensities are located too high.

SUMMARY OF THE INVENTION

Accordingly, it is an object of the present invention to provide a headlight for a vehicle which avoids the disadvantages of the prior art.

In keeping with these objects and with others which become apparent hereinafter, one feature of present invention resides, briefly stated in a headlight for a vehicle in accordance with the projection principle in which a further shade device is arranged offset in direction of the optical axis of the first shade device and is changeable between at least a first condition and at least a second condition wherein the further shade device in its first condition screens a part of the light reflected by the reflector and passing on the first shade device in its first condition, in order to reduce maximum illumination intensity values produced by the light bundle exiting the headlight in its first operational condition, and the further shade device in its second condition screens only a small part of the light reflected by the reflector.

When the headlight is designed in accordance with the present invention, the production of the bright-dark limit in the first operational condition of the headlight is performed by the first shade device in its first condition and the position of the regions with maximum illumination intensity values can be selected as required for the light bundle emitted by the reflector in the second operational condition, without taking into consideration of the low maximum illumination intensity values which are permitted from the light bundle emitted in the first operational position of the headlight, which are maintained by the second shade device by screening of a part of the light produced with the maximum illumination intensity value.

In accordance with a further feature of the present invention, the further shade device is arranged after the first shade device is considered in a light outlet direction. This provides the advantage that the bright-dark limit is produced by the further shade device without being influenced by the first shade device.

In accordance with still another feature of the present invention the further shade device is curved in direction of an optical axis preferably concavely. This has the advantage that during shading with a further shade device, a homogenous transition is produced.

In still another embodiment of the invention, the further device is formed so that in the first condition the light which passes on the first shade device and illuminating the opposite traffic side in front of the vehicle is screened in a greater part than the light passing on the first shade device which illuminations the traffic light itself in front of the vehicle. This provides an improved illumination of a traffic side in front of the vehicle.

Finally, in accordance with still another feature of the present invention, the shade devices are coupled with one another and together are movable between the first and second conditions. This provides for a simple construction of the headlight, since both shade devices can move with a single adjusting element.

The novel features which are considered as characteristic for the present invention are setforth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
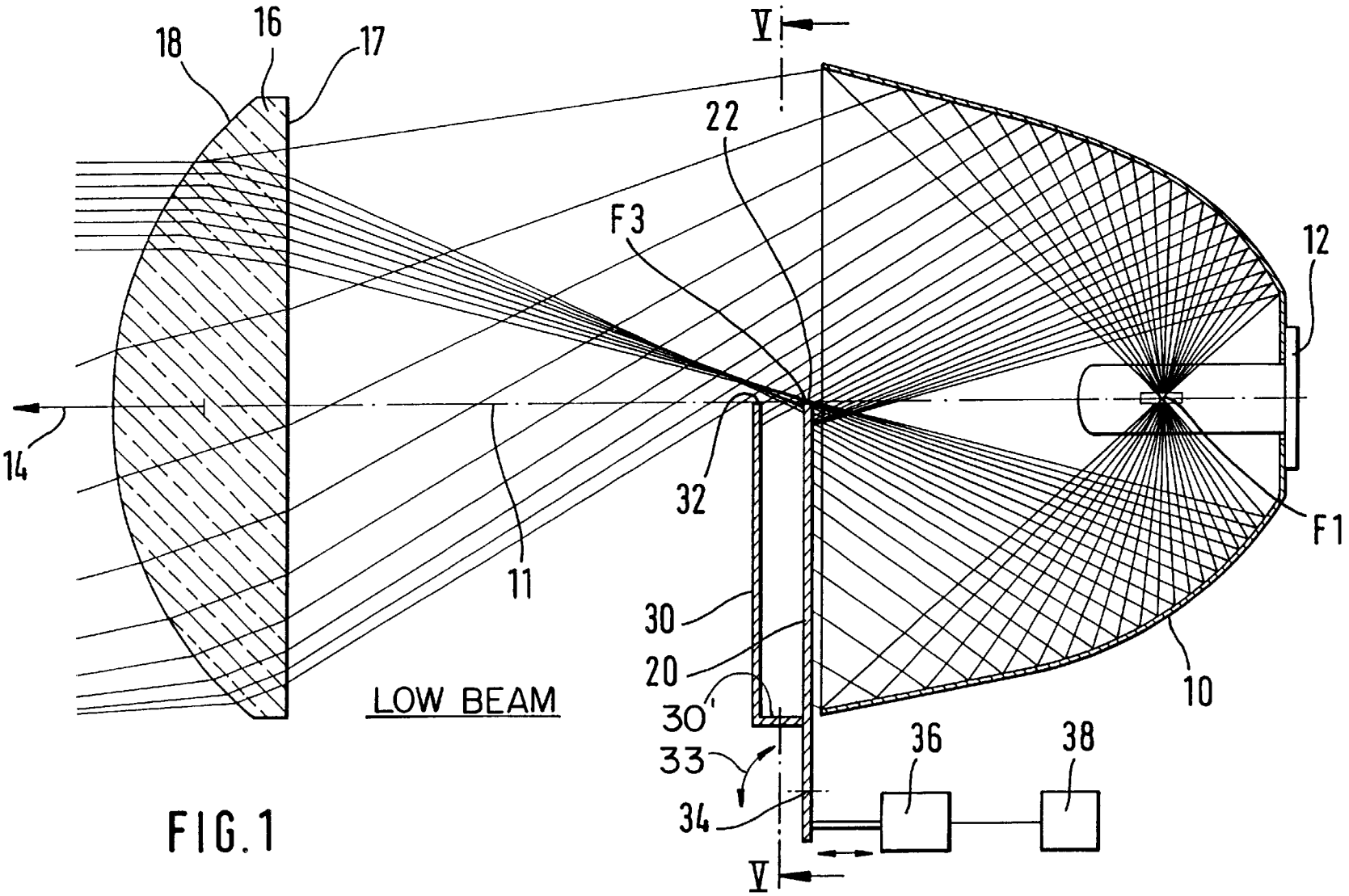
FIG. 1 is a view showing a headlight in accordance with the present invention in a vertical longitudinal section with shade devices in accordance with a first embodiment in a first condition for a low beam.
Figure 2:
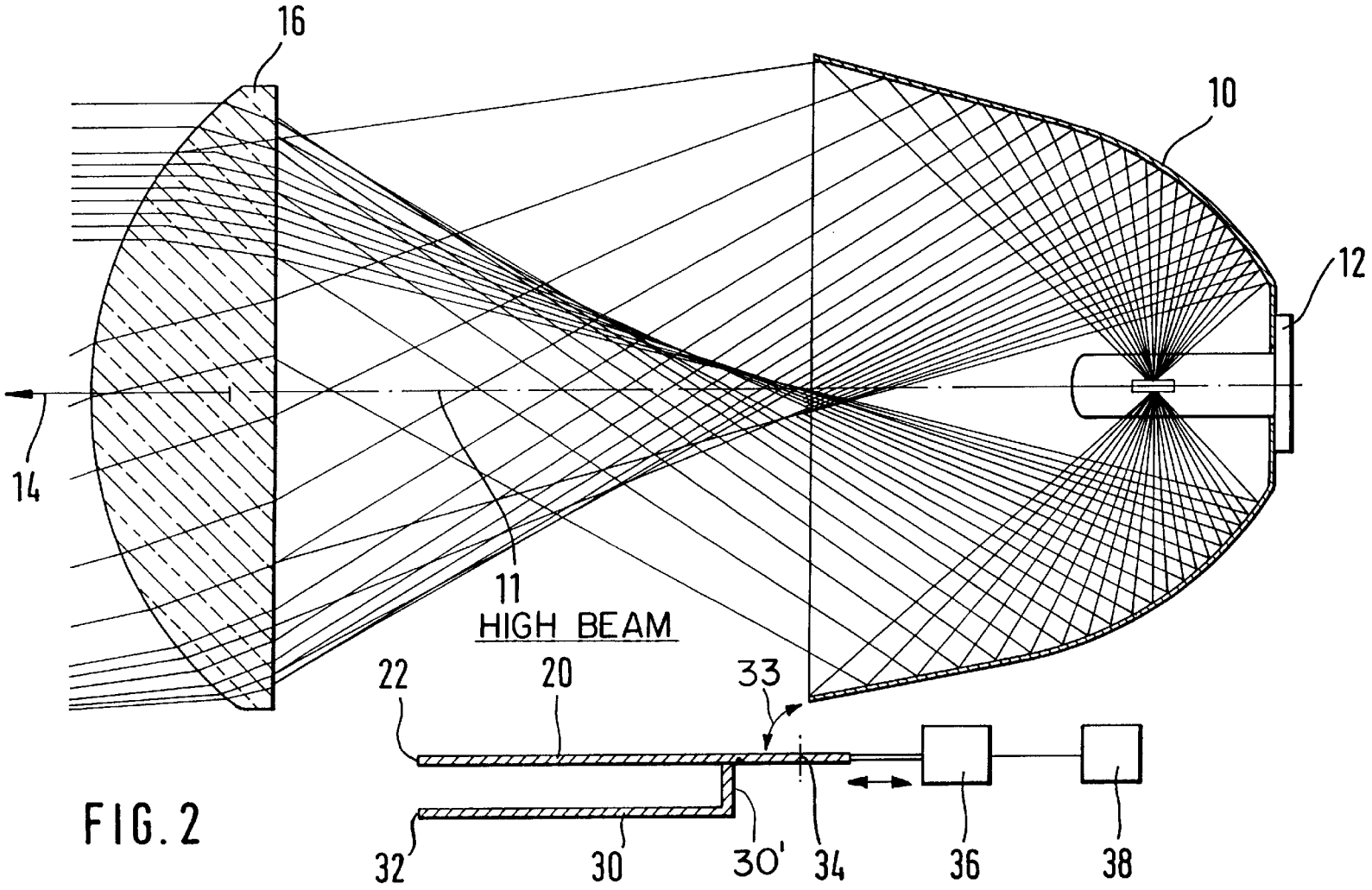
FIG. 2 is a view showing a headlight with the shade devices in a second condition for a high beam.
Figure 3:
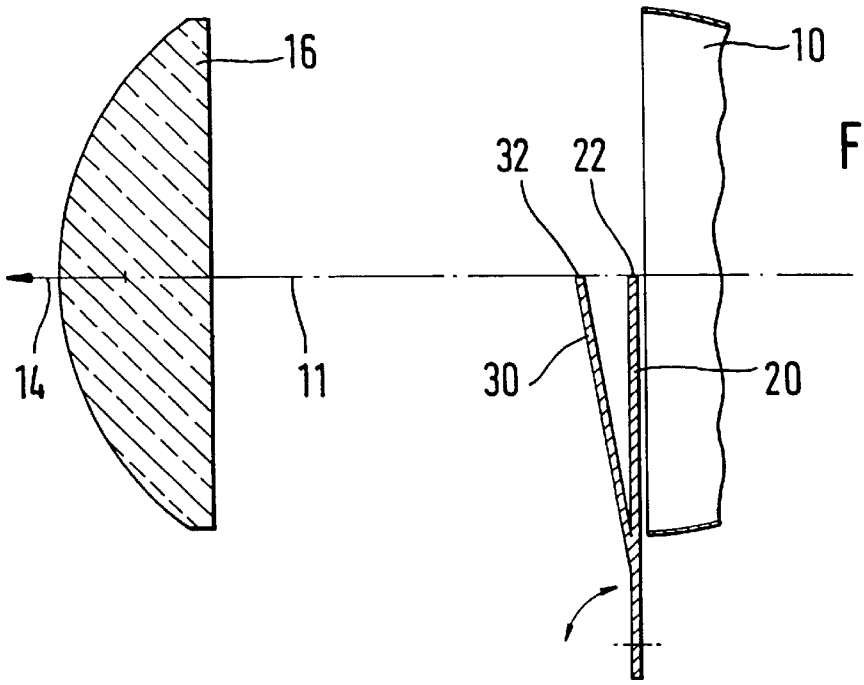
FIG. 3 is a view showing a section of the shade devices in accordance with a modified embodiment.

A headlight as shown in FIGS. 1–6 operates in accordance with the projection principle and is used for a vehicle, in particular a motor vehicle. It serves for selective generation of different light bundles. In particular, a headlight for selected generation of a low beam and a high beam will be described herein below. The headlight has a concave curved reflector 10 with a light source 12 arranged in its apex region. The light source 12 can be an in condensate lamp or preferably a gas-discharge lamp and its light body, or in other words its in condensate coil or its light arc is arranged substantially parallel to its optical axis 11 of the reflector 10. The reflector 10 is formed so that the light emitted by the light source 12 is reflected by the reflector is a converging light bundle. The reflector 10 can have at least approximately ellipsoidal shape, or any other shape, for example numerically determined shape. The light source 12 is arranged approximately in a first focal point F1 of the reflector 10 a surface which at least approaches its shape.

A lense 16 is arranged after the reflector 10 at a distance from it as considered in a light outlet direction 14. The lens 16 is formed as a collecting lens and has for example a substantially flat side 17 opposite to the light outlet direction 14 and facing the reflector 10 and a convex curve side 18 facing in the light outlet direction 14. The side 18 of the lens 16 can be spherical or preferably aspherical, so that the aspherical curvature the image forming error of the lens 16 can be corrected. The curvature of the side 18 of the lens 16 is determined so that the light reflector 10 is deviated during passage through the lens 16 in a predetermined manner. The lens 16 can be composed of glass or light-permeable synthetic plastic and held in a not shown manner, for example on a supporting element connected with the reflector 10.

A first shade device 20 is arranged between the lens 16 and the reflector 10. In the first embodiment shown in FIGS. 1 and 2 the first shade device 20 is light-impermeable and composed for example of a metal sheet or synthetic plastic. The first shade device 20 is arranged substantially under the optical axis 11 and is flat. The first shade device 20 has an upper edge 22. It is movable between a first position which it assumes in the operational position of the headlight for a low beam, and a second position which it assumes in the operational position of the headlight for high beam. The first shade device 20 is arranged preferably in the region of a focal point F3 of the lens 16 or a spherical lens at least approaching the lens 16.

In its first position for low beam the first shade device 20 is arranged as shown in FIG. 1 substantially perpendicular to the optical axis 11 and its upper edge 22 is arranged substantially at the height of the optical axis 11. The upper edge 22 of the first shade device 20 can be arranged substantially under or substantially over the optical axis 11. In its first position for low beam in accordance with FIG. 1, a part of the light reflected by the reflector 10 is screened by the shade device 20 and thereby a bright-dark limit of the light which then passes through the lens 16 is produced. The position and the course of the bright-dark limit is therefore determined by the upper edge 22 of the first shade device 20. The bright-dark limit produced by the upper edge 22 of the first shade device 20 is formed through the lens 16.

A second shade device 30 is laterally offset relative to the first shade device 20 in direction of the optical axis 11. In the shown embodiment the second shade device 30 is arranged after the first shade device 20 in the light outlet direction 14 and is composed of a light impermeable material, such as for example metal sheet or synthetic plastic. The second shade device 30 is also movable between a first position for the operational position of the headlight for a low beam and a second position for the operational position for the headlight for high beam. In FIG. 1 the second shade device 30 is arranged in its first position for low beam, in which its upper edge 32 is located substantially at a height of the optical axis 11 or substantially under or above it. Due to the second shade device 30, a part of the light reflected by the reflector 10 and passing on the first shade device 20 is screened. Due to the arrangement of the second shade device 30 laterally offset in the light outlet direction 14 relative to the first shade device 20, no sharp bright-dark limit is produced, but instead a weakening of the light passing through the lens 16 is provided.

Figure 4:
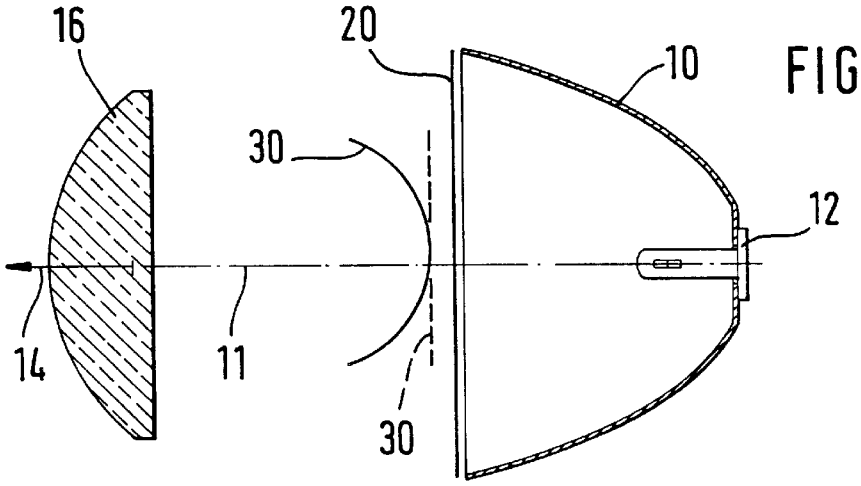
FIG. 4 is a view showing a headlight in a horizontal position section with the shade devices in accordance with a further modified embodiment.

FIG. 4 shows the devices 20, 30 in their second positions for the operational position of headlight for high beam. The shade devices 20, 30 are arranged somewhat farther in the beam course of the light reflected by the reflector 10 when compared with their first positions, so that they screen only a smaller part of the light reflected by the reflector 10. Preferably, the shade devices 20, 30 move completely from the beam course of the light reflected by the reflector 10 so that the total light reflected by the reflector 10 can pass through the lens 16.

The shade devices 20, 30 can move between their both positions, for example transversely to the optical axis 11 or around an axis 34 which extends transversely to the optical axis 11. The movements of the shade devices 20, 30 are actuated by at least one adjusting element 36 which engages them and is activated by a control device 38. The adjusting element 36 can be for example an electric motor, an electromagnet, a hydraulic or pneumatic adjusting drive, or any other device. Both shade devices 20, 30 can be arranged separately from one another. In this case for the movement between their both positions, a joint adjusting element 36 which engages both shade devices 20, 30 can be provided, or separate adjusting element 36 can be provided. In the case of separate adjusting element 36, an independent movement of the shade devices 20, 30 between their first and second positions is possible. Preferably, both shade devices, 20, 30 are coupled with one another, so that their movement can actuated by a joint adjusting element 36 and only one support for the shade devices 20, 30 in the headlight is needed. The adjusting element 36 is activated by the control device 38 during the switching of the headlight between its operational position for low beam and its operational position for high beam.

For example it is possible to support the first shade device 20 in the headlight so that the movement between both positions is possible, while the second shade device can be fixedly connected with the first shade device 20 or formed of one piece with it. In the embodiment shown in FIGS. 1 and 2 the second shade device 30 is connected on its lower edge with a spacer piece which extends from the first shade device 20 in the light outlet direction 14 to support the second shade device 30 at a distance from the first shade device 20 substantially perpendicular to the optical axis 11 until its upper edge 32. In this exemplary embodiment the substantially parallel shade devices 20, 30 are rotated jointly between their low beam and high beam positions, as indicated by arrows 33. In the modified embodiment shown in FIG. 3 the second shade device 30 is directly connected at its lower edge with the first shade device 20 and extends from there inclinedly upwardly and in the light outlet direction 14 until its upper edge 32 is opposite the upper edge 22 of the first shade device.

FIG. 4 shows the headlight in a horizontal longitudinal section, in which the reflector 10 with the light source 12 and the lens 16 and the shade devices 20, 30 are shown in their first position for low beam. The first shade device 20 extends substantially perpendicular to the optical axis 11. The second shade device 30 can also extend substantially perpendicular to the optical axis 11 as shown in a broken line in FIG. 4. However, as shown in FIG. 4 in a solid line, in accordance with a modified embodiment, it can be curved in direction of the optical axis 11. The second shade device 30 extends in particular with a concave curvature in the light outlet direction 14. The advantage of this curved embodiment of the second shade device 30 will be explained herein below in connection with the operation of the headlight.

Figure 5:
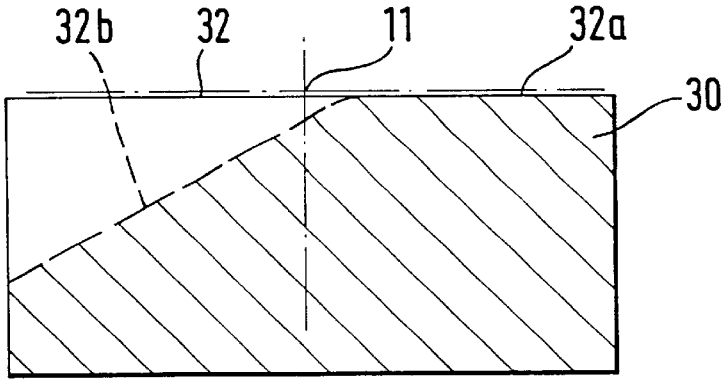
FIG. 5 is a view showing a shade device in a cross-section along the line V—V in FIG. 1.

FIG. 5 shows the second shade device 30 in direction of the optical axis 11. The upper edge 32 of the second shade device 30 can be substantially horizontal in the first position for low beam and, as described above, located at the height of the optical axis 11 or substantially under or over the same. Alternatively, the upper edge 32 as shown in FIG. 5 in a broken line, can have a course which deviates from the horizontal direction. For example, the upper edge 32 on a side, on which the light reflected by the reflector 10 and illuminating the opposite traffic side passes, can have a substantially horizontal portion 32*a* extending at a height of the optical axis 11 or substantially below or above the same. In the shown embodiments of the headlight for the right traffic, the counter traffic side is the left side in front of the vehicle and due to the side image forming of the upper edge 32 through the lens 16, the horizontal portion 32*a* of the upper edge as seen in the light outlet direction 14 in FIG. 5 is arranged right of the optical axis 11. At the side of the second shade device 30, at which the light reflected by the reflector 10 and illuminating the traffic side passes, the upper edge has an inclined portion 32*b* extending from the horizontal portion 32*a* inclinedly downwardly. In the shown embodiment of the headlight for the right traffic, the inclined portion 32*b* of the upper edge is arranged left of the optical axis 11. When the headlight is designed for the left traffic, the arrangement of both portions 32*a*, 32*b* of the upper edge is mirror-symmetrical relative to the optical axis 11 with respect to the arrangement shown in FIG. 5.

The first shade device 20 and/or the second shade device 20 additionally to the above described movement possibilities between the first and second conditions for the switching between low beam and high beam, can be also movable in a different way. For example, a turning around the optical axis 11 or around an axis substantially parallel to it can be provided. Thereby a change of the position of the upper edges 22 and 32 of the shade devices 20, 30 can be performed. For example a switching between the right traffic and the left traffic can be performed, so that the shade devices 20, 30 are arranged to produce the bright-dark limit on the counter traffic side by the high regions of their upper edges 22, 32. Alternatively, the whole headlight unit with the reflector 10, light source 12 lens 16 and the shade devices 20, 30 can be turnable about the optical axis 11 or an axis extending parallel to it.

Figure 6:
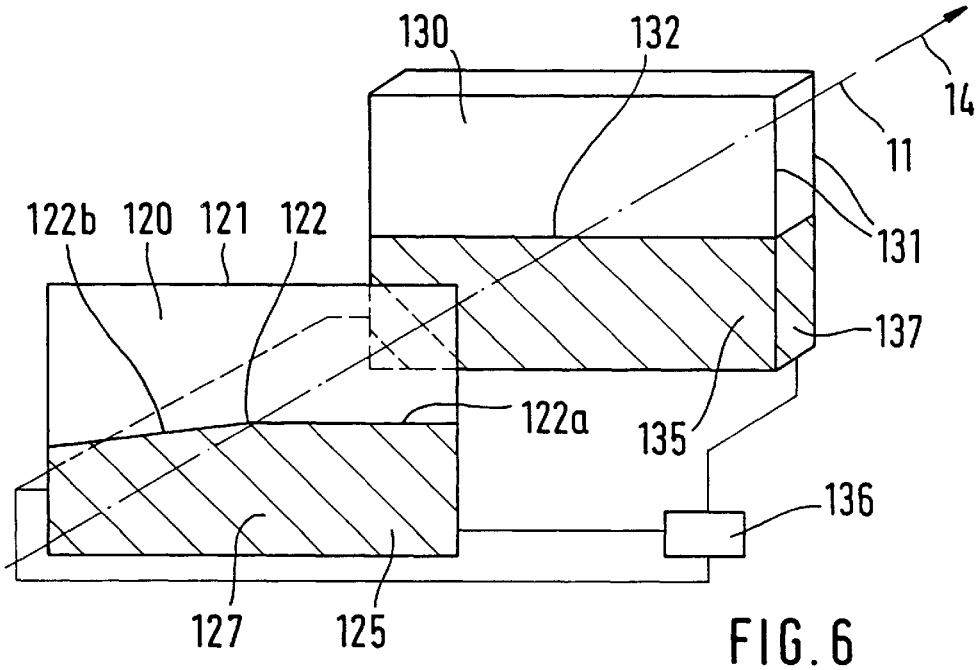
FIG. 6 is a view showing the shade devices of the headlight in a perspective in accordance with a second embodiment.

FIG. 6 shows both shade devices 120, 130 in accordance with a second embodiment. The basic construction of the headlight is not changed with respect to the first embodiment, but both shade devices 120, 130 are arranged immovably and stationary in the headlight. The shade devices 120, 130 have at least regions 125, 135 with changeable light permeability, which are arranged as the above described shade devices 20, 30 in their first position for low beam. The regions 125, 135 are arranged substantially under the optical axis 11 and extend up to the height of the optical axis 11 and/or substantially above or below the same. The changeable light permeability of the region 125 of the shade device 120 can be arranged by providing a light permeable base body in form of a disc 121 with a coating 127. Under the action of an electrical voltage, it can change its light permeability between a condition of higher light permeability and a condition of lower light permeability. The coating 127 can be composed of so-called electro chromic materials. The disc 121 can be provided only in the region 125 or extends over a greater part of the beam course of the light reflected by the reflector 10 and have a coating 127 only in the region 125.

The second shade device 130 can be formed in the same way. Alternatively. the shade device 130 in the region 135 can be provided with two light permeable discs 131 arranged at a distance from one another in direction of the optical axis 11 and a material 137 which has a changeable light permeability for example under the action of an electrical voltage can be provided between them. The material 137 can be formed for example by liquid crystals which change their orientation under the action of an electrical voltage, so that the material is switchable between a condition of a higher light permeability and a condition of a lower light permeability. The disc 131 can be provided only in the region 135, or extend over a greater part of the beam course reflected by the reflector 10. The material 137 is however arranged only in the region 135. The first shade device 120 can be formed in the same manner.

In the operational position in the headlight for low beam, the regions 125, 135 of the shade devices 120, 130 are located in their condition of lower light permeability or they are light-impermeable, so that a part of the light reflected by the reflector 10 is screened by them as in the first embodiment. The bright-dark limit of the low beam bundle is produced by the upper 122 of the region 125 of the first shade 120, and a part of the light passing on the region of the first shade device 120 is screened by the region 135 of the second shade device 130, to reduce the maximum illumination intensity value. In the operational position in the headlight for high beams, the regions 125, 135 of the shade devices 120, 130 are located in their condition of high light permeability, so that the light reflected by the reflector 10 can pass through them and through the lens 16. The dispersion of the electrical voltages applied to the regions 125, 135 of the shade devices 120, 130 is performed by a control device 136, which is controlled with the switching between the operational position for low beam and the operational position for high beam.

As explained in connection with the first embodiment, the position and the course of the bright-dark limit of the low beam bundle exiting the headlight in the operational position for low beam is determined by the upper edge 22 of the first shade 20 or the upper edge 122 of the region 125 of the first shade device 120. FIG. 6 shows a course of the upper edge 122 of the region 125 of the first shade device 120. The edge on the side of the optical axis 11, on which the light reflected by the reflector 10 and illuminating the counter traffic side passes, has a substantially horizontally extending portion 122 extending at the height of the optical axis 11 or substantially under it. As explained above, the edge 122 is formed by the lens 16 at the traffic side, so that the portion 122*a* in the shown embodiment for the right traffic at the right optical axis 11. At the side of the optical axis 11, at which the light reflected by the reflector 10 and illuminating the traffic side or in other words the left side, the edge 122 has a portion 122*b* which extends from the horizontal portion 122*a* to the left and falls downwardly. When the headlight is designed for the light traffic, the arrangements of the portions 122*a,* 122*b* relative to the optical axis 11 is mirror-symmetrical to the arrangement shown in FIG. 6. As described in connection with the first embodiment, also at least one of the shade devices 120, 130 in accordance with the second embodiment can be provided with the regions 125 and 135 formed so that the higher located portion 122*a* or 132*a* of the edges 122 or 132 produces the bright-dark limit at the counter traffic side, and therefore a switching between right traffic and left traffic is possible.

When the low beam bundle exiting the headlight in the operational position for low beam must have a differently shaped bright-dark limit, the corresponding shaping of the edge 122 of the first shade device 120 can provide the same. For example, the edge 122 at both sides of the optical axis 11 can be provided with a substantially horizontal portion, and the portions are connected with one another by an inclined portion, wherein the edge at the side, on which the light illuminating the counter traffic side passes, is arranged higher than at the other side. The upper edge 132 of the region 135 of the second shade device 130 can extend as before horizontally, or can have portions extending at different heights as shown in FIG. 5.

In the first embodiment, in the second embodiment the total headlight unit with the reflector 10, light source 12, lens 16 and the shade devices 120, 130 can be turnable about the optical axis 11 or an axis which extends parallel to it, for changing the length of the shade devices 120, 130 for example for switching between right and left traffic.

Figure 7:
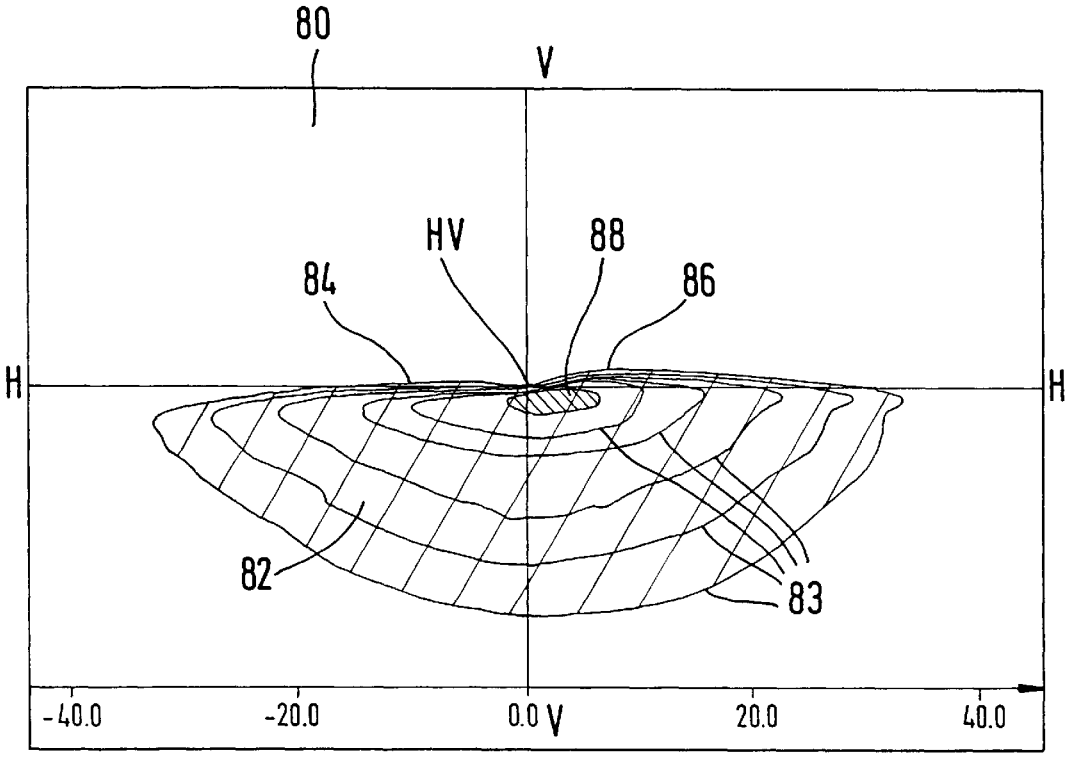
FIG. 7 is a view showing a measuring screen arranged in front of the headlight during illumination by a low beam bundle exiting the headlight.
Figure 8:
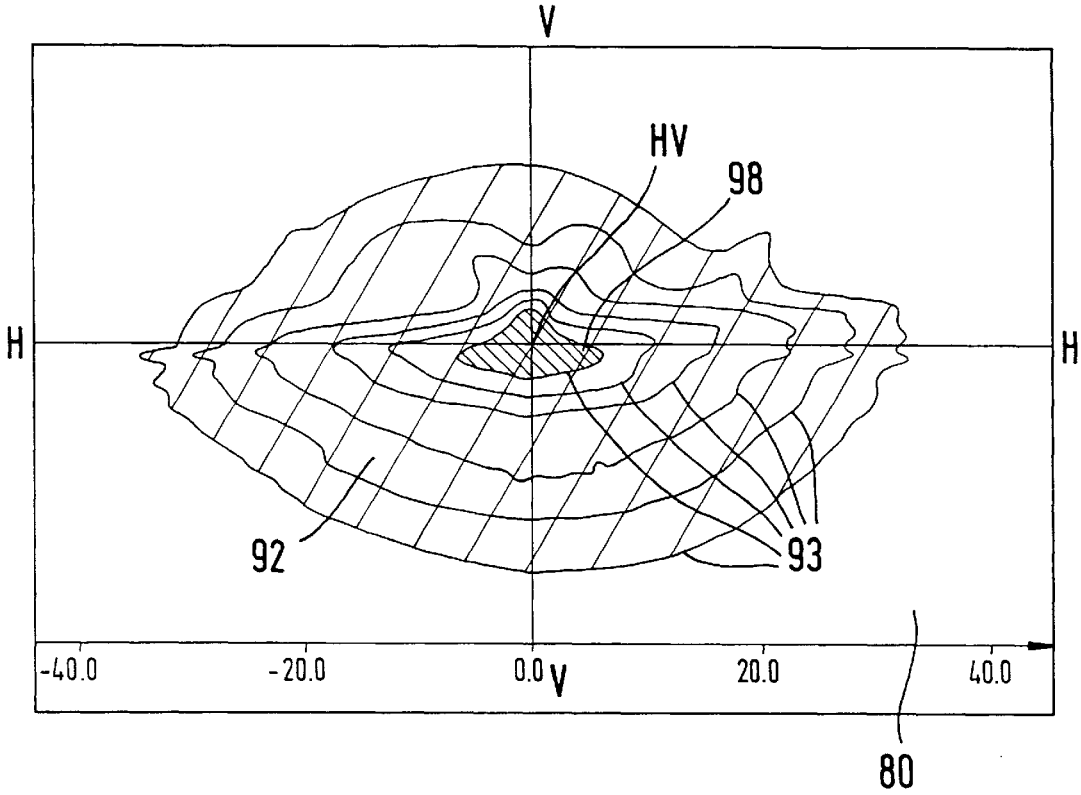
FIG. 8 is a view showing a measuring screen during illumination by the high beam bundle exiting the headlight.

The characteristics of the light bundles emitted by the headlight and their operational positions for low beam and high beam are explained herein below. A measuring screen 80 is arranged at a distance from the headlight as shown in FIGS. 7 and 8, and illuminated by the light bundles emitted by the headlight. The vertical central plane of the measuring screen 80 is identified as VV and its horizontal central plane is identified as HH. The vertical central plane VV and the horizontal central plane HH intersect in a portion HV. The optical axis 11 of the reflector 10 is inclined relative to the point HV downwardly by an angle of approximately 1%.

In the operational position of the headlight for low beam with the shade devices 20, 30 or 120, 130 in their first position or in their first condition, a low beam bundle is emitted by the reflector and illuminates at a region 82 on the measuring screen 80. The region 82 is limited from above by a bright-dark limit which is produced by the upper edge 22 of the first shade device 20 or the upper edge 122 of the portions 122*a,* 122*b* of the second shade device 120. The bright-dark limit has correspondingly the upper edge 22 or the upper edge 122 on the counter traffic side which for the right traffic is the left side of the measuring screen 80, a substantially horizontal extending portion 84 substantially under the horizontal central plane HH, and the portion 86 which extends at the traffic side or in other words for the right traffic at the right side of the measuring screen 80 from the horizontal portion 84 raising to the right. The portion 84 of the bright-dark limit is produced by the portion 122 of the edge 120 and the portion 86 is produced by the portion 122*b*.

The highest illumination intensity values are available in the region 82 closesly under the bright-dark limit 84, 86 substantially right of the vertical central plane VV in a zone 88. In accordance with the standards accepted in Europe, they can amount maximum to substantially 40–70 lux. This maximum permissible illumination values are obtained so that a part of the light reflected by the reflector 10 and passing on the first shade device 20 or 120 is screened by the second shade device 30 or 130, which illuminates the measuring screen 80 in the zone 88. The illumination intensity values increase to the edges of the region 82 starting from the maximum values available in the zone 88. In the region 82 several lines 83 of the same illumination intensity or so-called isolux lines are plotted to illustrate the distribution of the illumination intensity. The region 82 extends in a horizontal direction to approximately 30–40° as both sides of the vertical central plane VV, where the illumination intensity values are available of approximately one lux.

In the operational condition of the headlight for high beam with the shade devices 20, 30 or 120, 130 in their second position or their second, light-permeable condition, a high beam bundle is emitted by the headlight and illuminates the measuring screen 80 of FIG. 8 in a region 92. In the region 92 the highest illumination intensity values are available in a zone 98 around the point HV, which amounts to approximately 100–180 lux. In the region 92 several isolux lines 93 are again plotted for illustration of the distribution of the illumination intensity. The region 92 extends in a horizontal direction to approximately 30–40° at both sides of the vertical central plane VV, where the illumination intensity values of approximately one lux are available. The extension of the region 92 in a horizontal direction corresponds at least substantially to the extension of the region 82 in a horizontal direction since it is not influenced by the shape devices 20, 30 or 120,130. Since the first shade device 20 in its second position or the first shade device 120 in its second, light-permeable condition is located, the region 92 however does not have the bright-dark limit 84, 86 of the region 82 and since the second shade device 30 in its second position was the second shade device 130 in its second light-permeable condition is located, the zone 98 of the maximum illumination intensity value of the region 92 is higher and arranged around the point HV than the zone 88 of the maximum illumination intensity value of the region 82.

The inventive headlight can be designed so that in the operational position for high beam a high beam bundle is emitted which illuminates the measuring screen 80 of FIG. 8 in the region 92, in which as prescribed by the regulations in the zone 92 around the point HV the maximum illumination intensity values of a sufficient height are available. In the operational position for low beam due to the first shade device 20 or 120 the bright-dark limit 84, 86 of the region 82 in FIG. 7, and by the second shade device 30 or 130 the maximum illumination intensity values at the height are weakened as permitted for the low beam in accordance with the regulations. Because of the curved course of the second shade device 30 shown in FIG. 4 in direction of the optical axis 11 a homogenous transition of the illumination intensity values in the region 82 is obtained, so that here no disturbing abrupt weakenings of the illumination intensity values are available. Because of the arrangement of said second shade device 30 or 130 which is displaced in direction of the optical axis 11 to the focal point F3 of the lens 16, its upper edge 32 or its upper edge 132 is not projected sharply through the lens 16. Due to the course of the upper edge 32 of the second shade device 30 shown in FIG. 5, a strong retraction of the illumination intensity values on the counter traffic side or in other words at the left side of the measuring screen 80 in FIG. 7 is provided as desired, whereby for the low beam only low illumination intensity values are available.

It is also possible that the first shade device 20, 120 and the second shade device 30, 130 are formed differently. The shade device in accordance with the first embodiment is designed movably, and the shade device in accordance with the second embodiment is designed stationary with changeable light-permeability. The reflector carrier of the light source 12 as well as the lens 16 and the shade devices 20, 30, or 120, 130 can be arranged in a not shown housing of the headlight. In the course of beam of the light extending through the lens 16, a further disc can be arranged which can serve as a cover disc of the headlight and can be formed smooth, so that light passing through it without being influenced. On the other hand, the optical profile can be provided so that the passing light is deviated and/or dispersed. It is to be understood that more two shade devices 20, 30 or 120, 130 can be provided in the headlight.

The inventive headlight has been described as operating for selectively producing the low beam and the high beam. However, the use of the inventive headlight is not limited to this, but instead it is possible to provide a selected emission of different light bundles, with the shade devices 20, 30 or 120, 130 in its first condition emitting a light bundle with a bright-dark limit produced by the first shade device 20 or 120, and with the shade device 20, 30, or 120, 130 in their second condition emitting a light bundle with a greater range and higher maximum illumination intensities. It is also possible to switch the second shade device 30 or 130 independently from the first shade device 20 or 120 between its first and second condition, so that also when the first shade device 20 or 120 is located in its first condition and produces the bright-dark limit, the second shade device 30 or 130 is located in its second condition and the light bundle exiting the headlight has a bright-dark limit but higher maximum illumination intensities.

It is also possible that the second shade device 30 has several parts or the second shade device 130 has several regions 135, which are movable independently from one another or switchable between their light-permeable and light-impermeable condition so as to provide a desired partial screening of the light reflected by the reflector 10. Moreover, it is also possible that at least one of the shade devices 20, 30 or 120, 130 is changeable not only between two conditions, but instead are changeable steplessly or in several steps between various conditions, in order to vary the part of the light reflected by the reflector 10 which is screened by the shade devices 20, 30 or 120, 130. For example, the illumination intensities the traffic side and the counter traffic side can be varied in a different manner. Also, the expansion of the regions 82 or 92 of the measuring screen 80 illuminated by the light bundle emitted by the reflector can be expanded between a concentration and a wider expansion. A one-side wide expansion can be adjusted, preferably during drive over a curve and in the direction of the roadway course. A wide expansion is preferably during a drive over a curve or poor visibility, while a concentration is advantageous in particular at high speeds. It can be also provided that a fog light bundle with throughgoing horizontal bright-dark limit and a greater dispersion width can be emitted by the headlight in the first position of the shade devices 20, 30 or 120, 130.

It will be understood that each of the elements described above, or two or more together, may also find a useful application in other types of constructions differing from the types described above.

While the invention has been illustrated and described as embodied in headlight for vehicle in accordance with the projection principle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A headlight for a vehicle operating in accordance with a projection principle, comprising a light source; a reflector reflecting in a direction of an optical axis a light emitted by said light source; a lens arranged in a course of light reflected by said reflector; at least one first shade device located between said reflector and said lens and changeable between at least one first condition for a first operational position of the headlight and at least one second condition for a second operational position of the headlight, said at least one first shade device in said first condition screening a part of the light reflected by said reflector and producing a bright dark limit of a light bundle exiting the headlight, and in said second condition screening at most only a smaller part of a light reflected by said reflector than in said first condition; and at least one further shade device changeable between said first condition and said second condition, said at least one further shade device in said first condition being laterally offset in the direction of said optical axis relative to said at least one first shade device, thus screening a part of a light reflected by said reflector past said first shade device in said first condition so as to reduce a maximum illumination intensity value produced by a light bundle exiting the headlight in said first operational position without producing a further sharp bright-dark limit in said bundle, said at least one further shade device in said second condition screening at most only a smaller part of a light reflected by said reflector.

2. A headlight as defined in claim 1, wherein said at least one further shade device is arranged in a light outlet direction after said first shade device.

3. A headlight as defined in claim 1, wherein said at least one first shade device and said at least one further shade device are changeable independently from one another between said first and second conditions.

4. A headlight as defined in claim 1, wherein said at least one further shade device is formed so that a light which passes through said at least further shade device in said first condition on said at least one first shade device which illuminates a counter traffic side in front of the vehicle is screened to a greater part than the light passing on said at lest one first shade device which illuminates a traffic side in front of the vehicle.

5. A headlight as defined in claim 1, wherein at least one of said shade devices at least partially has a changeable light permeability and switchable between said first condition with a lower light permeability and is said second condition with a higher light permeability.

6. A headlight as defined in claim 1, wherein said shade devices are formed so that in said first operational condition with said shade devices in said first condition a low beam bundle is emitted, and in said second operational condition with said shade devices in said second condition a high beam light is emitted.

7. A headlight as defined in claim 1, wherein said light source is a gas discharge lamp.

8. A headlight as defined in claim 1, wherein said at least one further shade device is curved in direction of said optical axis.

9. A headlight as defined in claim 8, wherein said at least one further shade device is concavely curved.

10. A headlight as defined in claim 1, wherein at least one of said shade devices is light-impermeable and is movable between said first and second conditions.

11. A headlight as defined in claim 10, wherein said shade devices are coupled with one another and jointly movable between said first and second conditions.

12. A headlight for a vehicle operating in accordance with a projection principle, comprising a light source; a reflector reflecting a light emitted by said light source; a lens arranged in a course of light reflected by said reflector; at least one first shade device located between said reflector and said lens and changeable between at least one first condition for a first operational position of the headlight and at least one second condition for a second operational position of the headlight, said at least one first shade device in said first condition screening a part of the light reflected by said reflector and producing a bright-dark limit of a light bundle exiting the headlight, and in said second condition screening at least only a smaller part of a light reflected by said reflector than in said first condition; and at least one further shade device arranged in a direction of an optical axis offset relative to said at least one first shade device and changeable between at least one first condition and at least one second condition, said at least one further shade device in said first condition screening a part of a light reflected by said reflector and passing on said first shade device in said first condition so as to reduce a maximum illumination intensity value produced by a light bundle exiting the headlight in said first operational position, said at least one further shade device in said second condition screening at least only a smaller part of a light reflected by said reflector, said shade devices are formed so that in said first operational condition with said shade devices in said first condition a low beam bundle is emitted, and in said second operational condition with said shade devices in said second condition high beam light is emitted, said shade devices are being so that the high beam bundle emitted by the headlight in said second operational condition with said shade devices in their second operational position illuminates a measuring screen arranged in front of the headlight in a region in which in a central zone of said measuring screen maximum illumination intensity values are provided for approximately 100–200 lux, and in said first operational position with said shade devices in said first condition the emitted low beam bundle illuminates said measuring screen in a region which is limited above by the bright-dark limit produced by said first shade device, and in a zone under the bright-dark limit and at the traffic side of the measuring screen maximum illumination intensity values of 40–80 lux are provided.

* * * * *